United States Patent [19]

Oberndorfer

[11] 4,407,489

[45] Oct. 4, 1983

[54] APPARATUS FOR DISCHARGING HOT FLOWABLE SOLIDS FROM AN UPRIGHT CONTAINER, PARTICULARLY FOR DISCHARGING SPONGE IRON FROM A SHAFT FURNACE

[75] Inventor: Ernst Oberndorfer, Ried, Austria

[73] Assignee: Voest Alpine Aktiengesellschaft, Linz, Australia

[21] Appl. No.: 445,769

[22] Filed: Nov. 30, 1982

[30] Foreign Application Priority Data

Dec. 7, 1981 [AT] Austria ..... 5230/81

[51] Int. Cl.[3] ..... F27B 1/20

[52] U.S. Cl. ..... 266/191; 75/33; 414/209; 432/98; 432/235; 266/195

[58] Field of Search ..... 432/98, 235; 266/191, 266/195; 75/33; 414/209

[56] References Cited

U.S. PATENT DOCUMENTS 2,301,791 11/1942 Pitre ..... 432/235
4,005,857 2/1977 Colautti ..... 266/195

FOREIGN PATENT DOCUMENTS 829423 1/1952 Fed. Rep. of Germany .
2209258 9/1973 Fed. Rep. of Germany .

*Primary Examiner*—M. J. Andrews
*Attorney, Agent, or Firm*—Kurt Kelman

[57] ABSTRACT

A discharge implement is provided, which is operable to discharge sponge iron from a shaft furnace and constitutes the bottom structure of the shaft furnace and is formed with flow passages for a cooling liquid. In order to ensure a uniform discharge, the discharge implement consists of a grate, which comprises parallel grate bars, which are non-circular in cross-section and are operable to perform rotational oscillations about their respective longitudinal axes. The grate bars are hollow so that they can conduct a cooling liquid, and they surround and are radially spaced from an inner tube, which has at least one opening, through which the interior of the inner tube communicates with the annular space defined between the inner tube and the shell of the grate bar.

5 Claims, 4 Drawing Figures

1
2
2
3
4
6
8
13
15
16
II
II

APPARATUS FOR DISCHARGING HOT FLOWABLE SOLIDS FROM AN UPRIGHT CONTAINER, PARTICULARLY FOR DISCHARGING SPONGE IRON FROM A SHAFT FURNACE

This invention relates to apparatus for discharging hot flowable solids from an upright container, particularly for discharging sponge iron from a shaft furnace, which apparatus comprises a discharge implement which constitutes the bottom structure of the container and is adapted to be driven and has flow passages for conducting a cooling liquid.

For the discharge of hot sponge iron from a shaft furnace it is known from Laid-open German Application No. 22 09 058 to provide a discharge plate, which is adapted to be reciprocated on a discharge deck and can be used to force a sponge iron layer under the column of sponge iron to lateral discharge openings. To eliminate the need for expensive materials in the discharge plate, which is subjected to a high heat load, the discharge plate is provided with flow passages for a cooling liquid, which is supplied through tie rods, which are connected to the discharge plate and serve to operate the latter. A disadvantage of that known discharge apparatus resides in that the reciprocable discharge plate cannot ensure a discharge which is uniform over the cross-section of the shaft furnace but the horizontal stratification will be disturbed by the different vertical movements of the subsiding sponge iron. Besides, the discharge plate cannot be uniformly cooled unless the cooling liquid flows at a relatively high velocity so that the cross-sections of flow must be small if cooling liquid is to be used at an economically reasonable rate. But small cross-sections for the flow of the cooling liquid involve the risk of a vaporization of the cooling liquid in the discharge plate and of a superheating of the vapor if the proper supply of the cooling liquid is disturbed. This will necessarily result in an overheating of the discharge plate.

In an attempt to effect a uniform discharge of flowable solids over the cross-section of a container, it has been proposed in German Patent Specification No. 829,423 to provide a container bottom structure consisting of a grate having parallel grate bars, which are non-circular in cross-section and are driven to perform rotational oscillations about their respective longitudinal axes. Because the grate bars are non-circular in cross-section, their rotary movement results in an opening and closing of discharge gaps, through which the flowable solids are discharged. When the grate bars are in an initial position, the gaps which are formed between them as a result of their rotational oscillation are closed at least to such an extent that solid particles cannot pass between the grate bars. For this reason the grate bars must be able to support the weight of the column of solids contained in the container. But the grate bars can hardly be supported from underneath because they must move and because free cross-sections are required between the grate bars for the flow of the solids. For this reason that known discharge apparatus cannot be used for a discharge of hot solids, such as sponge iron, because the heat loading of the grate bars will substantially reduce their carrying capacity.

It is an object of the invention to provide for the discharge of hot solids apparatus which is of the kind described first hereinbefore and which is so improved that a uniform discharge throughout the cross-section of the container can be ensured with structurally simple means.

This object is accomplished according to the invention in that the discharge implement consists of a grate having parallel grate bars which are non-circular in cross-section and operable to perform rotational oscillations about their respective longitudinal axes, the grate bars are hollow for conducting cooling liquid, and each grate bar surrounds and is radially spaced from an inner tube, which communicates through at least one opening with the annular space defined by said inner tube and the shell of the grate bar.

The fact that flowable solids can be discharged from a container in a uniform distribution over the cross-section of the container through a grate having grate bars which are adapted to be driven to perform rotary oscillations is not surprising, even for a discharge of hot solids. But it is surprising that a cooling which is sufficiently uniform over the length of the grate bars and ensures that the grate bars have an adequate strength can be effected by the additional features which have been described. The annular space between the inner tube and the shell of each grate bar has a cross-section of flow which ensures that the cooling liquid when supplied at an economically reasonable rate will flow at such a high velocity that the temperature of the grate bars can be maintained substantially constant throughout their length. Nevertheless, the volume of liquid within the grate bars is sufficient for preventing damage in the case of short-time disturbances in the supply of the cooling liquid. This is due to the fact that the inner tube surrounded by the shell of the grate bar is also filled with cooling liquid and in case of an interruption of the supply of cooling liquid the cooling liquid contained in the inner tube must also be vaporized before the grate bars can be overheated. The inner tube does not contain a supply of cooling liquid so that the temperature of the latter will be more uniform but may also be used for carrying functions if the shell of the grate bar is connected to the inner tube by proper means.

It would be quite possible to introduce the cooling liquid at one end of each grate bar into the annular space between the shell of the grate bar and the inner tube and to withdraw the cooling liquid from the annular space at the other end of the grate bar. But particularly desirable conditions will be obtained if, in accordance with a further feature of the invention, the inner tube has a closed shell and is connected at one end to a cooling liquid supply line whereas the opposite end of the inner tube is open and the outlet fitting for the cooling liquid is disposed adjacent to that end of the grate bar which is associated with the supply line. Because the cooling liquid is supplied through the inner tube and is conducted back to the return conduct in the opposite direction through the annular space between the inner tube and the shell of the grate bar, the temperature of the grate bar will be highly uniform as an additional heat exchange between the cooling liquid which is supplied and that which is returned takes place through the wall of the inner tube so that a differential thermal expansion along the length of the grate bars will be virtually avoided.

Because the grate bars are subjected to the high temperatures of the hot solids to be discharged, a formation of vapor cannot be precluded. Such vapor must be properly removed, and dead zones in which vapor could accumulate should be avoided as far as possible.

As the cross-section of each grate bar is usually convexly curved on the side facing the solids, any vapor which is formed can be accumulated adjacent to the top of the grate bar. For a simple escape of such vapor, the fitting connected to the return conduit for the cooling liquid is desirably provided near the top of the grate bar. Particularly desirable conditions will be obtained if the fitting connected to the return line of the cooling liquid defines a vapor-collecting chamber, which tapers upwardly toward the return conduit so that any vapor which has formed will necessarily flow through that collecting chamber into the return conduit.

An illustrative embodiment of the invention is shown on the drawings, in which

Figure 2:
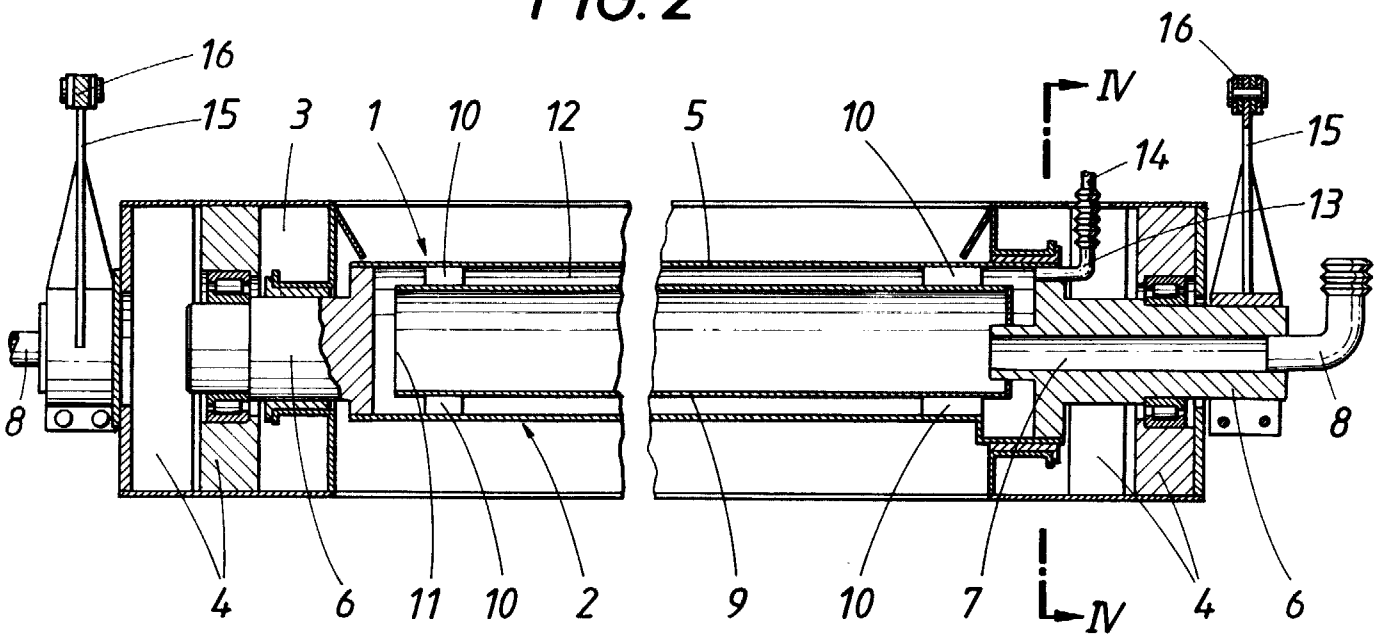
FIG. 2 is a sectional view taken on line II—II in FIG. 1 and showing the apparatus on a larger scale.

The illustrated apparatus for discharging hot sponge iron constitutes the bottom structure of a shaft furnace, which is not shown in detail. The discharge apparatus comprises a grate 1, which has parallel grate bars 2, which are rotatably mounted in a carrying frame 3. For this purpose the frame 3 is provided with bearings 4 and the arrangement is such that the bearings 4 for adjacent grate bars 2 are staggered approximately by the width of the bearing in the longitudinal direction of the grate bars so that the grate bars 2 can directly contact each other. Each grate bar 2 comprises a hollow shell 5, which is held at both ends by respective stub shafts 6, which are mounted in the bearings 4. One of said stub shafts 6 has a central bore 7, which is connected to a supply conduit 8 for a cooling liquid, which usually consists of water and through the bore 7 enters an inner tube 9. In accordance with FIG. 2 the inner tube 9 is tightly connected to the stub shaft 6, which is formed with the bore 7. The shell 5 of the grate bar surrounds the inner tube 9 and is radially spaced from it. The inner tube 9 is connected to the shell 5 of the grate bar 2 by spacers 10 so that the composite grate bar consisting of the shell 5 and the inner tube 9 has a relatively high fluxural strength.

At its end opposite to the stub shaft 6 provided with the bore 7, the inner tube 9 is open to communicate through the opening 11 with the annular space 12 between the inner tube 9 and the shell 5 of the grate bar. The annular space 12 opens into a fitting 13, which is provided in the stub shaft 6 having the bore 7 and through said fitting 13 communicates with a return conduit 14 for the cooling liquid so that the latter flows back through the annular space in the opposite direction.

Figure 3:
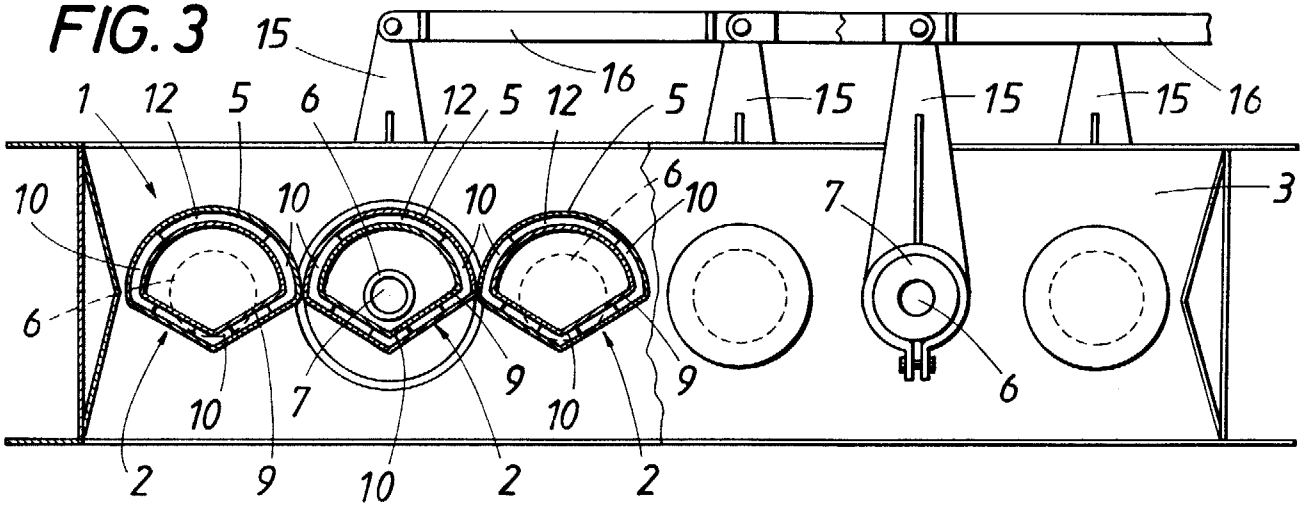
FIG. 3 is an end view, partly cut open, showing that apparatus.

As is particularly apparent from FIG. 3 the grate bars 2 are non-circular in cross-section and have a shell 5, which defines said cross-section and consists of a shell portion having the shape of one-half of a circular cylinder and two wall portions which extend from said shell portion and include an obtuse angle with each other. When the grate bars having such a non-circular cross-section are in their initial position, shown on the drawing, they constitute a substantially closed bottom structural, which supports the column of solids. When the grate bars are operated to perform rotational oscillations, they define discharge gaps between them for the discharge of sponge iron. Because the grate bars are operated to perform rotational oscillations about their respective longitudinal axes, which coincide with the center lines of the shell portions having the shape of one-half of a circular cylinder, there is no need for a displacement of sponge iron by the grate bars so that a relatively low power is sufficient to drive the grate bars. On the other hand the entraining of the solids to be discharged toward the discharge gaps between the grate bars can be assisted by radially protruding ribs or other radially projecting portions provided on the shells of the grate bars on that portion thereof which faces the column of solids.

The grate bars 2 are operated in a simple manner by crank arms 15, which are clamped to the stub shafts 6 and pivoted to connecting rods 16. The discharge rate can be controlled by an adjustment of the angle through which the grate bars are oscillated.

Figure 4:
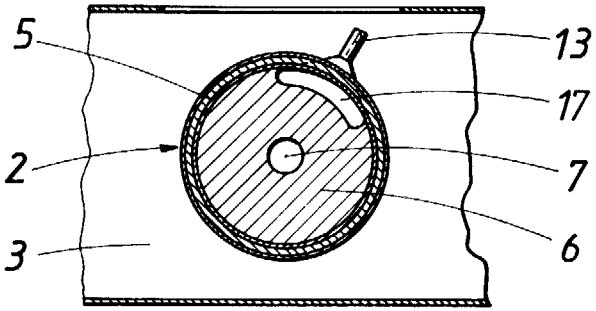
FIG. 4 is a transverse sectional view taken on line IV—IV in FIG. 2 and showing a grate bar.

Owing to the high temperatures, the cooling liquid must be expected to form vapor in the grate bars 2 so that any vapor which has formed must be discharged. For this purpose the fitting 13 which is provided in the top portion of each grate bar 2 and connected to the return conduit 14 for cooling liquid defines a vapor-collecting chamber 17, which tapers upwardly toward the return conduit 14, as is indicated in FIG. 4. This will ensure that any vapor bubbles which have formed will escape and that there is no risk of an accumulation of vapor bubbles in dead zones.

Figure 1:
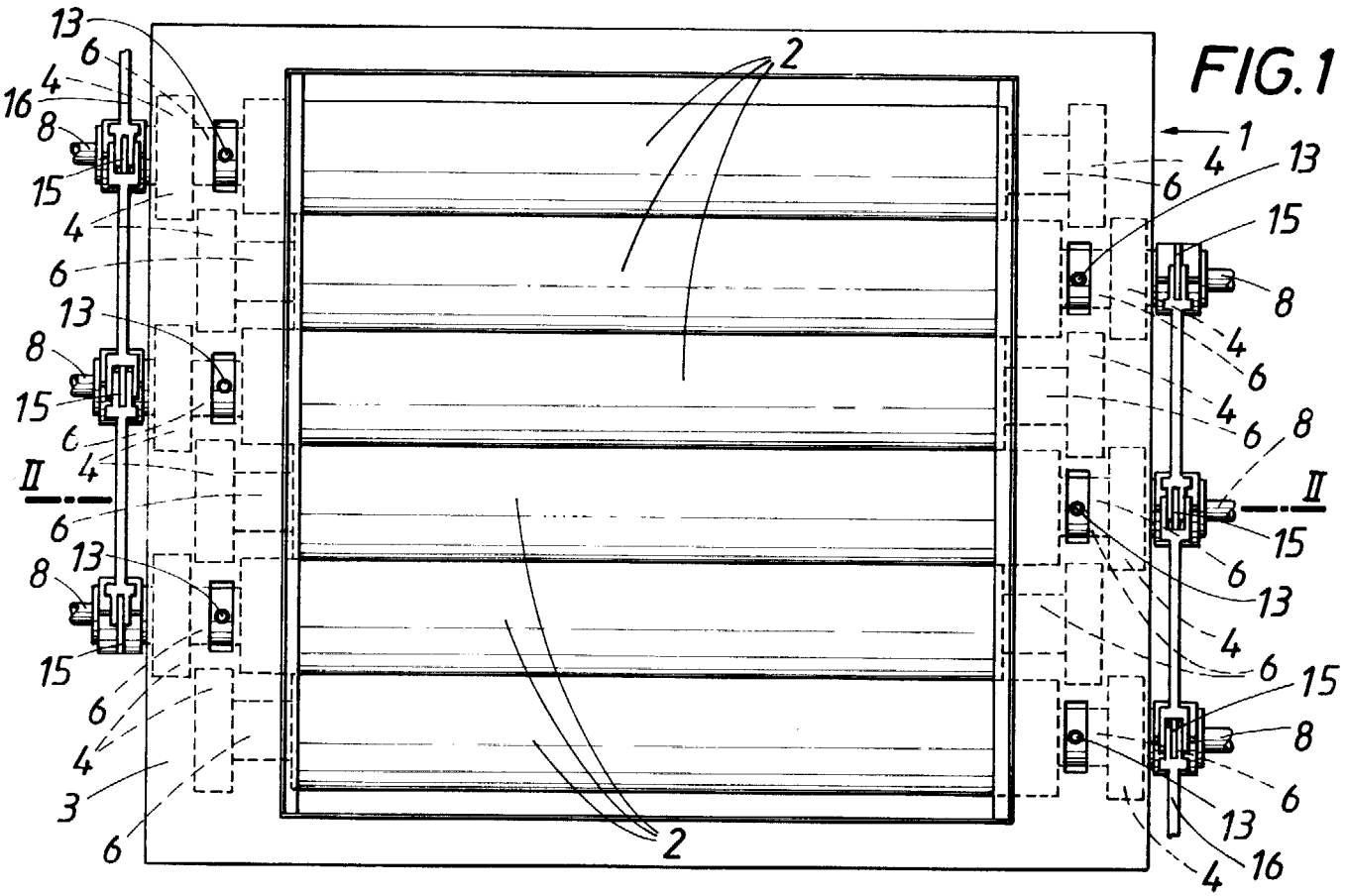
FIG. 1 is a simplified top plan view showing apparatus according to the invention for discharging sponge iron from a shaft furnace.

No discharge of solids must be permitted when the grate bars 2 are in their initial position. For this reason the grate bars must be closely spaced so that the space which is available in a lateral direction is closely restricted. For this reason the bearings 4 for adjacent grate bars are staggered in the longitudinal direction of the grate bars. For the same reason the fittings for the cooling liquid are provided at mutually opposite ends of adjacent grate bars, as is clearly apparent from FIG. 1.

It will be understood that the apparatus which has been illustrated and serves to discharge hot sponge iron from a shaft furnace can alternatively be used to discharge other hot flowable solids from another container if said solids can flow through the discharge gaps which are formed between the grate bars when the same are operated. The heat loading of the grate bars by the hot solids is kept within tolerable limits by the cooling which is effected and which is uniform over the length of the grate bars.

What is claimed is:

1. In apparatus for discharging hot flowable solids from an upright container having a bottom structure which is adapted to support a column of flowable solids, comprising a discharge implement which constitutes said bottom structure and is formed with flow passages for conducting a cooling liquid and is operable to effect a discharge of flowable solids from said column, and drive means for operating said discharge implement, the improvement residing in that said discharge implement consists of a grate having parallel hollow grate bars, which are non-circular in cross-section, each of said grate bars is mounted for rotation about its longitudinal axis, said drive means are operable to impart to each of said grate bars rotational oscillations about its longitudinal axis, each of said grate bars comprises an inner tube defining an inner flow passage and a shell which surrounds and is radially spaced from said inner tube to define an annular flow passage with said inner tube, each of said grate bars is provided with an inlet fitting for supplying cooling liquid to said inner and annular flow passages and with an outlet fitting for withdrawing cooling liquid from said inner and annular flow passages.

2. The improvement set forth in claim 1 as applied to apparatus for discharging hot flowable sponge iron from a shaft furnace constituting said container.

3. The improvement set forth in claim 1, wherein each of said grate bars is provided with said inlet fitting and said outlet fitting adjacent to one end of said grate bar and said inner tube has a closed shell and is connected at one end to said inlet fitting and is open at its other end.

4. The improvement set forth in claim 1, wherein each of said grate bars has a top portion and is provided with said outlet fitting in said top portion.

5. The improvement set forth in claim 4, wherein said outlet fitting has at its top an outlet opening for connection to a return conduit and said outlet fitting defines an internal vapor-collecting chamber which tapers toward said opening.

* * * * *